US005509536A

United States Patent [19]

Mannes

[11] Patent Number: 5,509,536

[45] Date of Patent: Apr. 23, 1996

[54] METHOD AND APPARATUS FOR THE SORTING OF FIBER SUSPENSIONS

[75] Inventor: Wolfgang Mannes, Günzburg-Reisensburg, Germany

[73] Assignee: Sulzer-Escher Wyss GmbH, Ravensburg, Germany

[21] Appl. No.: 213,604

[22] Filed: Mar. 15, 1994

[30] Foreign Application Priority Data

Mar. 16, 1993 [DE] Germany ..... 43 08 225.4

[51] Int. Cl.[6] ..... B07B 1/04

[52] U.S. Cl. ..... 209/273; 209/300; 209/389; 209/306

[58] Field of Search ..... 209/300, 305, 209/306, 352, 358, 379, 384–386, 389, 390, 397, 273

[56] References Cited

U.S. PATENT DOCUMENTS

| | | | |
|---|---|---|---|
| 3,456,793 | 7/1969 | Salomon | 209/306 X |
| 3,506,121 | 4/1970 | Holm | 209/358 X |
| 3,672,506 | 6/1972 | Syrajanen | 209/306 X |
| 3,786,918 | 1/1974 | Holz | 209/306 X |
| 3,865,243 | 2/1975 | Salminen | 209/306 X |
| 4,283,275 | 8/1981 | Heinbockel et al. | 209/358 X |
| 4,287,055 | 9/1981 | Holz | 209/306 X |
| 4,543,181 | 9/1985 | Greenwood | 209/389 X |
| 4,620,671 | 11/1986 | Skaar | 209/358 X |
| 4,717,471 | 1/1988 | Winkler | 209/300 X |
| 4,961,844 | 10/1990 | Ekholm et al. | 209/300 X |
| 5,064,537 | 11/1991 | Chupka et al. | 209/306 X |
| 5,071,543 | 12/1991 | Rajala | 209/306 X |

FOREIGN PATENT DOCUMENTS

| | | | |
|---|---|---|---|
| 3322578 | 12/1984 | Germany . | |
| 233493 | 4/1991 | Germany | 209/300 |

*Primary Examiner*—D. Glenn Dayoan

*Attorney, Agent, or Firm*—Townsend and Townsend and Crew

[57] ABSTRACT

In a sorting method for fiber suspensions, a dividing wall (3, 3') is used comprising openings via which the compenent particles in the suspension S to be sorted are classified according to their size. The beneficial transporting away of the rejected component particles is thus achieved on the inlet side (4) of the dividing wall (3,3') with the aid of flow blades (7,7'), whereas, on the outlet side (5), pressure pulses produced by clearers (6) act through the openings of the dividing wall preventing them from clogging up.

14 Claims, 3 Drawing Sheets

METHOD AND APPARATUS FOR THE SORTING OF FIBER SUSPENSIONS

BACKGROUND OF THE INVENTION

The invention relates to a method for the sorting of fiber suspensions and also to a sieve or screen apparatus for the implementation of said method.

Sorting methods are often applied in plants for the processing of used paper and sometimes also for the treatment of cellulose suspensions. The goal in such a treatment of fiber suspensions is the removal of impurities and of pieces of fiber material with insufficient solubility. A major consideration in this regard are contaminating materials which stem from the use of the paper and which would cause problems during processing and recycling of the prepared used paper. In particular, plastic contaminants, the glued spines of books and paper with a high wet strength should be considered. Other impurities can, in principle, also be removed by sieve apparatuses of this kind; but it is advisable for economic reasons in many cases to exploit the difference in density between such impurities and the suspension and through the use a hydrocyclone, this being particularly relevant for stones, shards of glass and metallic particles. Although styropor pieces also have, by virtue of their very small density, the property that they float very easily and are thus removable in hydrocyclones, they can, on the other hand, be easily compressed by mechanical forces to such an extent that their removal then becomes difficult. For this reason, it is often desirable to remove styropor pieces from the suspension at a very early stage in the preparation process.

In order that such a sorting process can be reliably implemented at all, the means for clearing described need to be employed. Along with the desired effect, namely to prevent the deposition on and the blocking of parts of the machine, they can also have undesired effects, namely to compress the solid particles, which are separable by virtue of their size, to such an extent that their removal becomes difficult. To avoid this disadvantage, it has already been attempted to dispose the clearing means on the reclaimed material side of the dividing means. However, this did not always result in adequate security against clogging, especially not under conditions of heavy soiling.

SUMMARY OF THE INVENTION

It is possible to fulfill the underlying object in that parts which are moveable relative to the dividing wall are present on both sides of the dividing wall which is provided with openings and serves for the retention of solid materials by virtue of their size. As a result, an intensive clearing of the openings in the dividing wall is possible at the outlet side by means of the clearers operating there, in particular due to pressure pulses and suction pulses which are sufficiently strong to act into and right through the openings. These pressure and suction pulses are a consequence of the large relative movement between suspension and clearers.

On the opposite side, i.e. the inlet side of the perforated dividing wall, a highly beneficial transporting away of the rejected material which collects there is made possible by the flow blades.

In the apparatuses provided for the implementation of the method, the flow blades are so designed and so positioned relative to the other machine parts that mechanical comminution of the solid material is extremely slight. Additionally, relatively large distances can be selected from the parts of the machine relative to which the flow blades move. Rounded-off edges can be provided at the flow blades and/or a cross-sectional geometry of the blades can be selected which is designed in such a way that the momentum transfer which takes place to the suspension is as extensive as possible, so that the relative movement between suspension and flow blades is reduced.

The action of the flow blades can be advantageously adjusted so that a transport movement of the solid materials at the inlet side occurs just at the moment when they are raised off the dividing wall by the pressure pulse of the clearers acting through the openings. Blocking of the openings in the dividing wall can thus not occur.

A mild mechanical loading of the fiber can however sometimes be desirable so long as no excessive comminution of the contaminant material occurs.

BRIEF DESCRIPTION OF THE DRAWINGS

The invention and its advantages will now be explained in further detail by way of example only and with reference to the FIGS. 1 to 4 which show.

DESCRIPTION OF THE SPECIFIC EMBODIMENTS

Figure 1A:
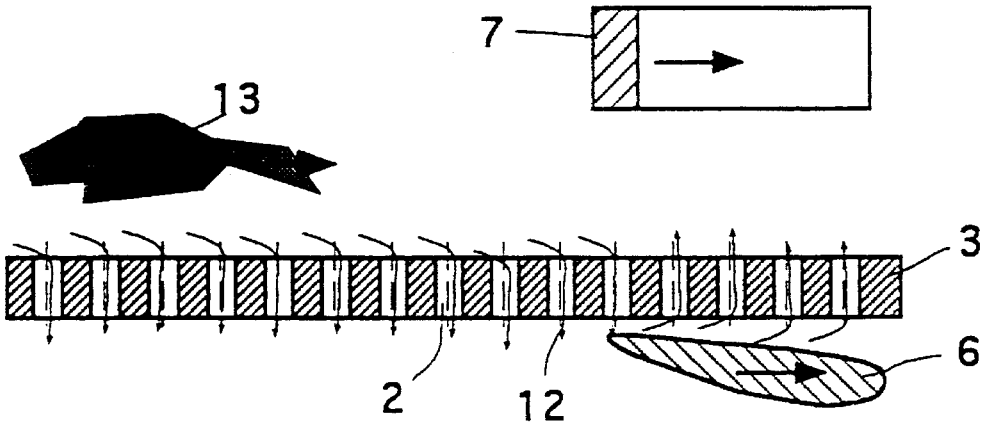
FIG. 1A–1C A rough schematic illustration of the operation of the sorting method in accordance with the invention, FIG. 2 A sieve apparatus with a planar dividing wall, FIG. 3 A detail view of the apparatus shown in FIG. 2, FIG. 4 A sieve apparatus with a cylindrical dividing wall, FIG. 5 A sieve apparatus with rotors of widely differing diameters.
Figure 1B:
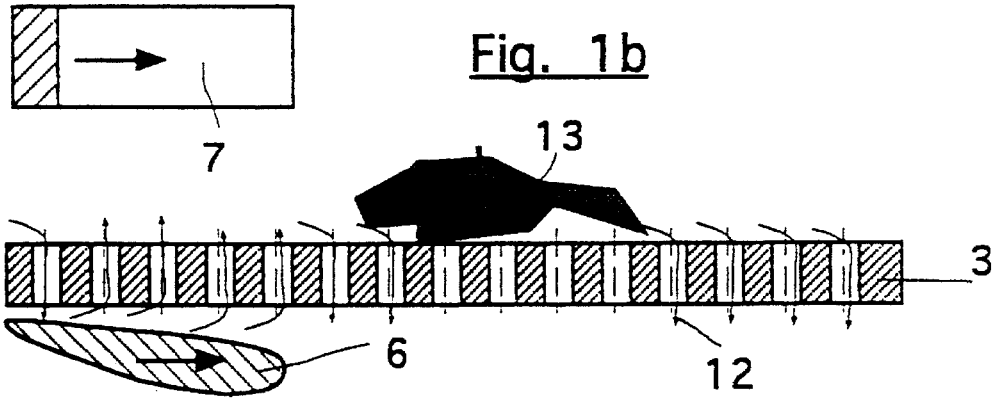
Figure 1C:
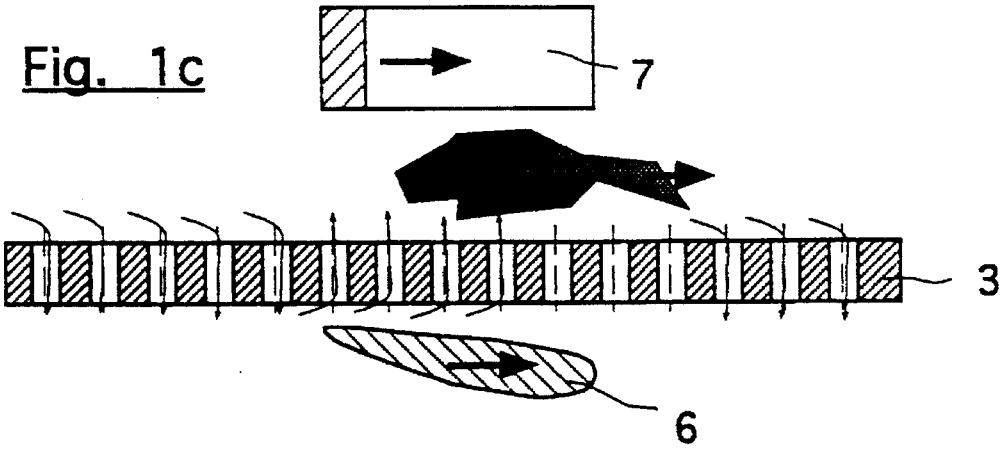

FIG. 1 shows in three stages (1A,1B,1C) a model of a sorting process in accordance with the invention in a rough schematic representation. In accordance with FIG. 1A, both a flow blade 7 and a clearer 6 move along a dividing wall 3 which serves as the dividing element. The flow of the suspension in the region of the openings 2 is indicated by the arrow 12. There, at the place where the clearer 6 passes by, a pressure pulse forms which causes flow-back through the openings of the dividing element. The solid particle 13 approaching the dividing element is already visible. In FIG. 1B, the solid particle 13 had landed on the dividing element 3 and has clogged a part of the openings. The next flow blade 7 and also the next clearer 6 are already approaching. As shown in FIG. 1C, the pressure pulse of the clearer 6 pushes the solid particle sufficiently far away from the dividing element 3 that it can be moved on by the flow induced by the blade 7.

Figure 2:
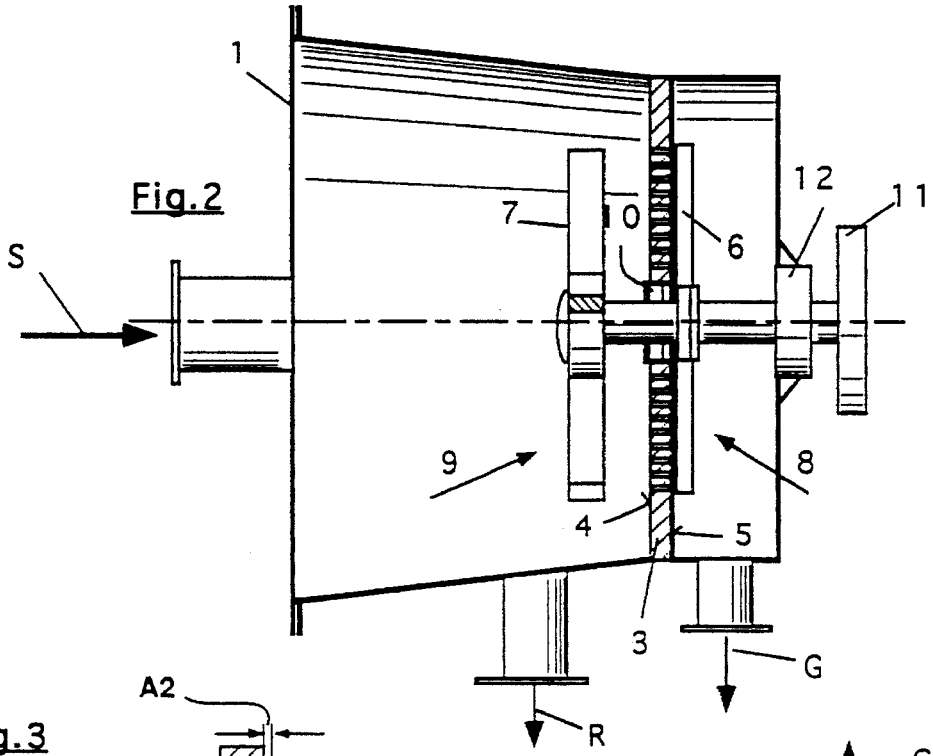
Figure 3:
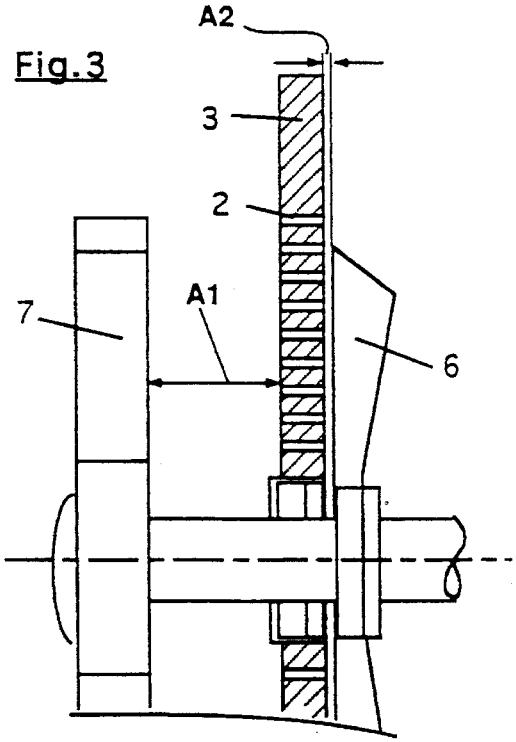

FIG. 2 shows as an example a sieve apparatus with which the method in accordance with the invention can be implemented. The figure schematically shows in a sectional side view a housing 1 which receives the suspension S and which includes a dividing wall 3 as the dividing element. The dividing wall 3 comprises a plurality of openings 2 (FIG. 3). The flow of suspension, which is able to pass through the dividing wall 3 via the openings 2, is fed out of the housing via a stub as reclaimed material G. The remainder also passes out of the housing but through a different stub and as reject R. In normal operation, the amount G is very much larger than the amount R.

Due to the action of the dividing wall, one can draw a distinction between an inlet side 4 and an outlet side 5. On the outlet side 5, the clearers 6 are visible these being a part of the clearer rotor 8. Clearing means in a more general sense are also situated on the inlet side 4 of the dividing wall 3, here in the form of flow blades 7. They are part of a bladed rotor 9 which—as shown here—is connected to the clearer rotor 8 via a shaft. This connection is however not necessary in every case although it is usually to be recommended for economic reasons.

For a connection of the two rotors of the type described above, the connection shaft passes here centrally through the dividing wall 3, wherein sealing parts 10 may be used. It can however also be the case that a gap remains there, through which a part of the suspension can flow. This would not be damaging so long as no coarse particles succeeded in reaching the reclaimed material and no blocking of this intermediate volume occurs.

The rotors are driveable, for instance via a pulley wheel 11. A mounting 12 is also indicated.

FIG. 3 represents a section of FIG. 2 and shows in particular how the distance A1 between flow blades 7 and dividing wall 3 as well as how the distance A2 between dividing wall 3 and clearers 6 is defined.

Figure 4:
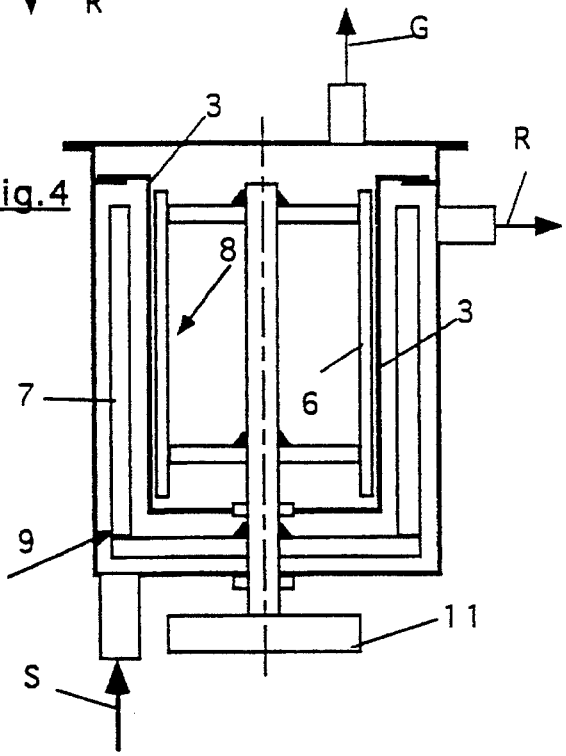

FIG. 4 shows in a schematic sectional representation a differently designed sieve apparatus in accordance with the invention in which the dividing wall 3 is constructed substantially circularly cylindrical, wherein the openings (not shown) for the transmission of the suspension are located in the cylindrical surface. Machines of this kind are referred to as pressure sorters and the dividing walls used therein as sieve baskets on account of their shape. The sorter drawn here has an inlet for the material suspension S on its radial outer wall so that the main flow of the suspension takes place radially from the outside inwards and so that the purified suspension can flow out from the interior of the sieve basket as reclaimed material G, in this case through the cover.

The particles held back as reject R are fed out of the ring volume to radially outside the sieve basket. Clearers 6 are visible on the outlet side, and flow blades 7 on the inlet side of the dividing wall 3. The clearers on the one hand and the flow blades on the other hand are, also in this case, associated with a respective rotor 8 and 9, and can be driven jointly via a pulley wheel 11.

Figure 5:
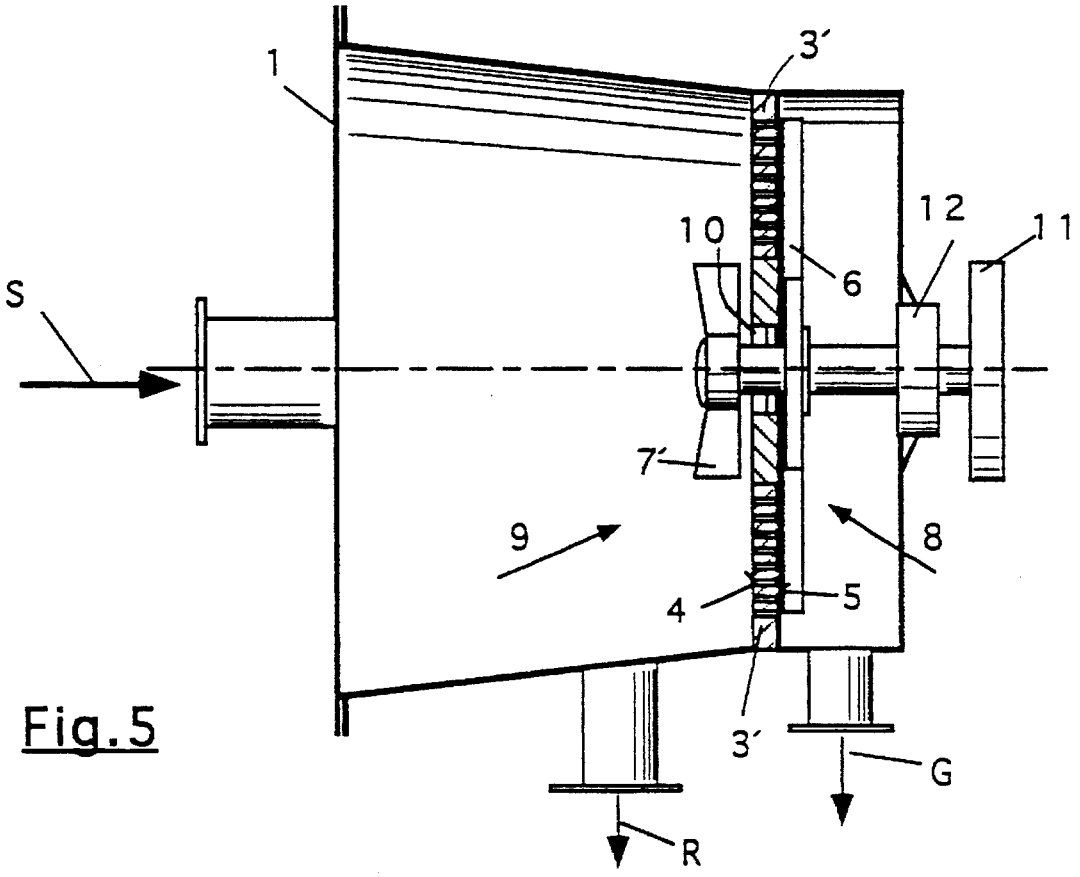

As a special feature of FIG. 5 is that the outer diameter of the rotor with the flow blades 7' is chosen so that it is slightly smaller than the inner diameter of the ring shaped perforated dividing wall 3'. As a result, the dividing wall 3' can be easily installed and removed from the inlet side 4 without having to remove rotor carrying the flow-blades 7'.

The rotor itself becomes smaller and hence cheaper. In operation, its effect extends into the region situated radially outwardly so that the holes can be kept clear by cooperation with the clearers 6 passing the dividing wall 3' close by.

It is known that sorters comprising sieve baskets can also function with flow from the inside radially towards the outside, wherein, when applying the invention, the more intensively acting clearers are situated radially outside the sieve basket and the less intensively acting flow blades radially inside.

I claim:

1. Method for the sorting of fiber suspensions, in particular for the removal of impurities from an aqueous suspension containing used paper, in a sieve apparatus by the holding back of solid material by virtue of their size on the inlet side of a dividing element which is provided with openings and allows water and fiber material to pass through to the outlet side, wherein a clogging of the sieve apparatus is prevented by clearing means which are moveable near to the flow outlets of the openings and produce hydraulic pressure pulses, characterized in that additional clearing means disposed on the inlet side in the region of the openings is operated less intensively than the clearing means disposed on the outlet side.

2. Sieve apparatus, in particular for the implementation of the method of claim 1 at or in a housing (1) for the receipt of the fiber suspension to be processed, said sieve apparatus comprising, as the dividing element, a dividing wall (3,3') provided with openings (2) for holding back solid materials at the inlet side (4) by virtue of their size, and which allows water and fiber material to pass through to the outlet side (5), wherein a clogging of the sieve apparatus is prevented by clearers moveable at a distance from, and along the dividing wall, characterized in that the pressure-pulse producing clearers (6) are disposed on the outlet side (5) of the dividing wall (3, 3') and, additionally, moveable flow blades (7, 7') are disposed on the inlet side (4) at a distance from and moveable along the dividing wall (3, 3').

3. Sieve apparatus in accordance with claim 2, characterized in that the clearers (6) moveable on the outlet side (5) of the dividing wall (3, 3') have a hydrodynamic profile for the production of pressure pulses substantially transverse to the direction of movement.

4. Sieve apparatus in accordance with claim 2, characterized in that the flow blades (7, 7') moveable on the inlet side (4) have the form of forwarding blades or pump blades.

5. Sieve apparatus in accordance with claim 2, characterized in that the distance (A1) of the flow blades (7, 7') disposed on the inlet side (4) from the dividing wall (3, 3') is more than twice as large as the distance (A2) of the clearers (6) on the outlet side (5) from the dividing wall (3, 3').

6. Sieve apparatus in accordance with claims 2, characterized in that the clearers (6) belong to a clearer rotor (8), and the flow blades (7, 7') belong to a bladed rotor (9).

7. Sieve apparatus in accordance with claim 6, characterized in that both rotors (8 and 9) are connected to one another and are driven with the same rotational speed.

8. Sieve apparatus in accordance with claim 2, characterized in that the distance (A2) between dividing wall (3, 3') and clearers (6) amounts to between 0.5 and 3 mm.

9. Sieve apparatus in accordance with claim 2, characterized in that the distance (A1) between the flow blades (7, 7') and the dividing wall (3, 3') amounts to between 20 and 50 mm.

10. Sieve apparatus in accordance with claim 2, characterized in that the dividing wall (3, 3') is a planar sieve sheet.

11. Sieve apparatus in accordance with claim 10, characterized in that the dividing wall (3') has a circular ring shape, and in that the radial outward extent of the flow blades (7') is smaller than the inner diameter of the dividing wall (3').

12. Sieve apparatus in accordance with claim 2, characterized in that the dividing wall (3) is part of a circularly cylindrical sieve basket.

13. Sieve apparatus in accordance with claim 10, characterized in that the openings (2) are a plurality of cylindrical holes.

14. Sieve apparatus in accordance with claim 12, characterized in that the openings (2) are a plurality of cylindrical holes.

* * * * *